US005398810A

United States Patent [19]

Yao Wang

[11] Patent Number: 5,398,810

[45] Date of Patent: Mar. 21, 1995

[54] TOOL BOX WITH COMPARTMENT COVER BOARDS

[76] Inventor: Li-Wen Yao Wang, 2 Fl., No. 252, Lane 415, Kuang Fu S. Rd., Taipei, Taiwan, Prov. of China

[21] Appl. No.: 189,752

[22] Filed: Feb. 1, 1994

[51] Int. Cl.[6] ..... B65D 85/28

[52] U.S. Cl. ..... 206/373; 206/372; 206/371

[58] Field of Search ..... 206/372, 373, 376, 377, 206/378, 379, 224, 234, 371; 220/528

[56] References Cited

U.S. PATENT DOCUMENTS

| | | | |
|---|---|---|---|
| 3,620,362 | 11/1971 | Valdes | 206/224 |
| 3,777,882 | 12/1973 | McIntyre | 206/372 |
| 4,591,056 | 5/1986 | Groch | 206/224 |
| 4,852,930 | 8/1989 | Agee | 206/457 |
| 4,938,355 | 7/1990 | Rocco | 206/372 |
| 5,071,004 | 12/1991 | Rivera | 206/372 |
| 5,117,979 | 6/1992 | Brightbill | 206/372 |

*Primary Examiner*—David T. Fidei
*Attorney, Agent, or Firm*—Bacon & Thomas

[57] ABSTRACT

A tool box having two hinged cover shells, each cover shell defining a plurality of compartments for keeping tools and tool accessories, and a compartment cover board fastened to either cover shell by fitting its bottom pins into respective pin holes on the cover shell to keep the stored tools and tool accessories in place, the compartment cover board having a plurality of storage chambers spaced around the periphery thereof for storing small measuring tools, weights and measures conversion tables and measuring scales respectively made on two opposite surfaces thereof, and a plurality of gage holes vertically disposed on one surface for keeping different gages.

5 Claims, 2 Drawing Sheets

TOOL BOX WITH COMPARTMENT COVER BOARDS

BACKGROUND OF THE INVENTION

The present invention relates to tool boxes, and more particularly relates to a compartment cover board for covering the tool compartments to keep the stored tools and tool accessories in place.

The tool compartments in a tool box are made open for receiving tools or tool accessories by insertion. The tools or tool accessories may fall out of the tool compartments easily when the tool box is opened. Therefore, the user must carefully open the tool box when to use the tools or tool accessories. Furthermore, during works, one may have to measure the measurements of different things and then convert the measurements from one unit to another. For doing these jobs, one shall have to prepare various instruments including calipers, rules, scales, gages, weights and measures conversion tables. etc.

SUMMARY OF THE INVENTION

The present invention has been accomplished under the aforesaid circumstances. The present invention provides a compartment cover board for covering the tool compartments on either cover shell of a suitcase-like tool box to keep the stored tools and tool accessories in place. The compartment cover board has storage chambers spaced around the periphery thereof for storing small measuring tools, weights and measures conversion tables and measuring scales respectively made on two opposite surfaces thereof, and gage holes vertically disposed on one surface for keeping different gages.

DETAILED DESCRIPTION OF THE PREFERRED EMBODIMENT

Figure 1:
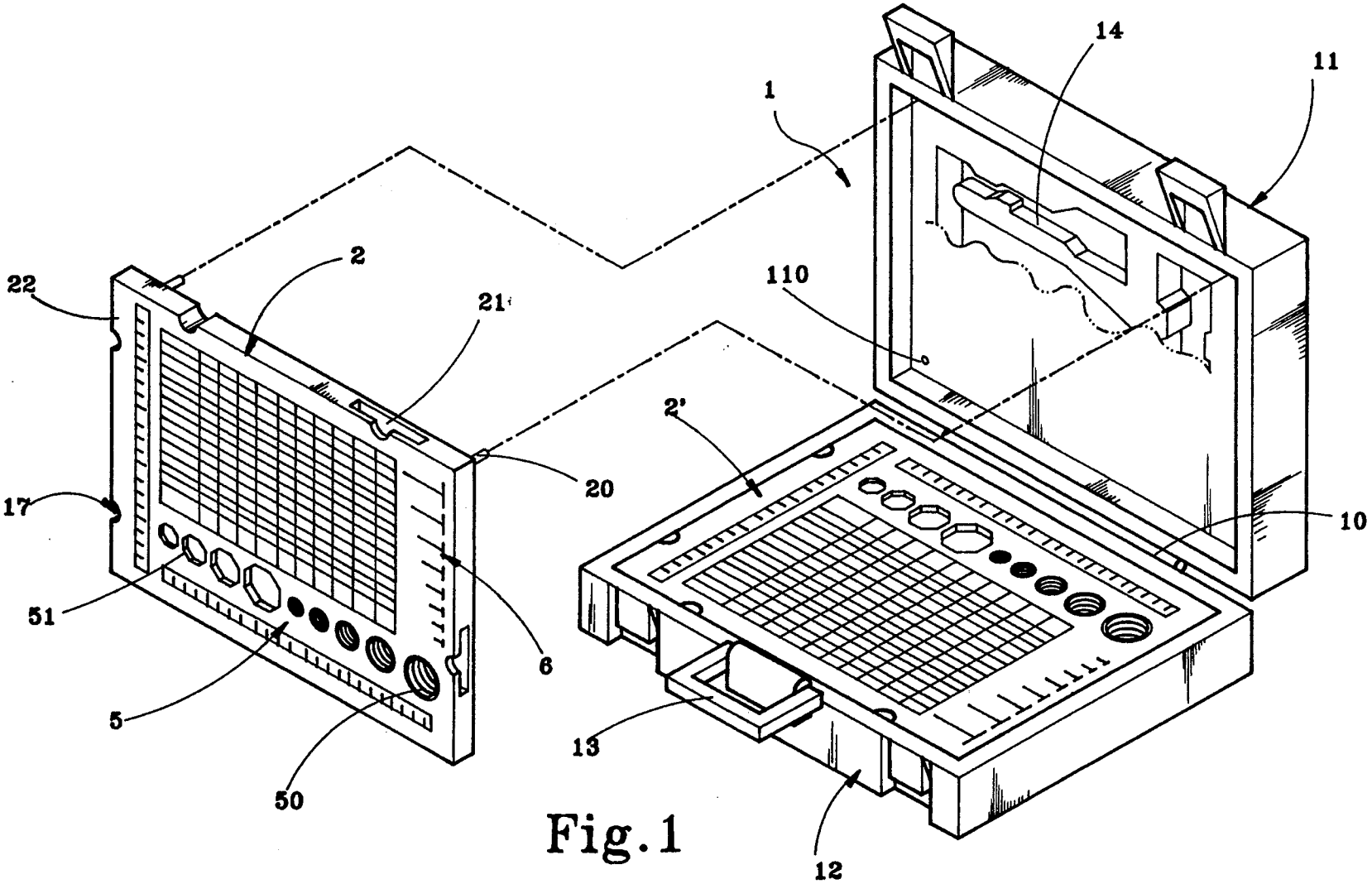
FIG. 1 shows a tool box having compartment cover boards according to the present invention.

Referring to FIG. 1, a tool box 1 is shown comprised of two opposite cover shells 11;12 hinged together by hinges 10. A carrying handle 13 is made on one cover shell 12 opposite to the hinges 10 for carrying by hand. Fastening devices 16 are made on the cover shells 11;12 at suitable locations for fastening them in the closed condition. Each cover shell 11 or 12 defines a plurality of tool compartments 14 on the inside for keeping different hand tools or tool accessories. A cover board 2 or 2' is fastened to either cover shell 11 or 12 on the inside and covered over the tool compartments 14 to keep the stored hand tools and tool accessories inside the tool compartments 14. The cover board 2 or 2' is made of flat shape in thickness about 1 cm, having a plurality of bottom pins 20 fitted into respective pin holes 110 on the inside of the cover shell 11 or 12. When the bottom pins 20 of the cover board 2 or 2' are respectively inserted into the pin holes 110 on the cover shell 11 or 12, the cover board 2 or 2' becomes covered over the tool compartments 14.

Figure 2:
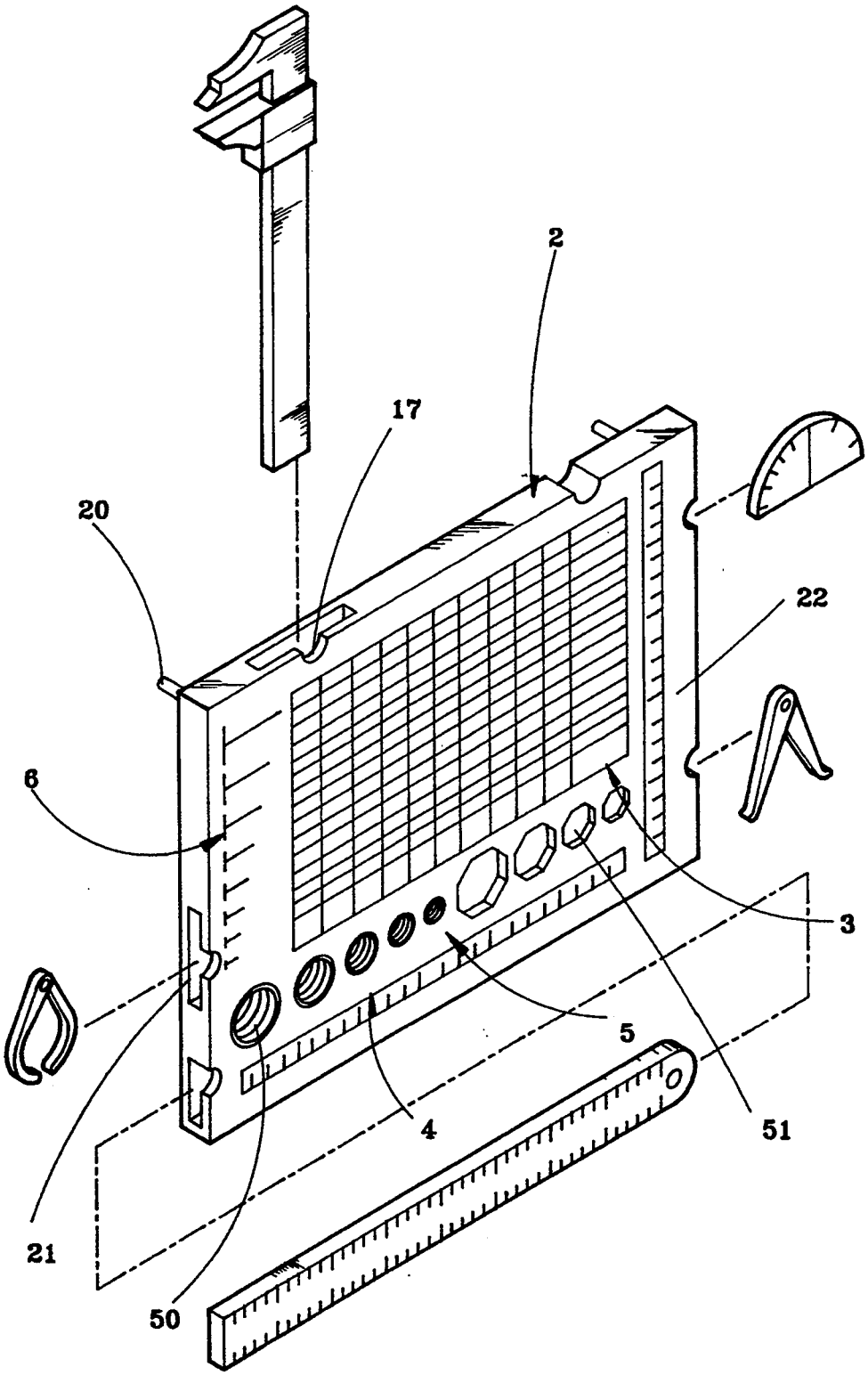
FIG. 2 shows a tool box compartment cover board according to the present invention.

Referring to FIG. 2, the cover board 2 comprises a plurality of storage chambers 21 spaced around the periphery thereof for storing small measuring tools such as calipers, steel rules, angle meters, etc. The depth of the storage chambers 21 must be sufficient to hold the small measuring tools completely on the inside. Each storage chamber 21 has a notch 17 on the orifice for inserting fingers. The top and bottom surfaces 22 of the cover board 2 are respectively marked with a weights and measures conversion table. The top surface of the cover board 2 is further marked with scales 4;6 for measurement. The cover board 2 further comprises a plurality of gage holes 5 spaced on the top surface thereof. These gage holes 5 include screw gage holes 50 for keeping screw gages, and nut and bolt gage holes 51 for keeping nut and bolt gages.

I claim:

1. A tool box having two hinged cover shells with pin holes and tool compartments for keeping tools and tool accessories in the tool compartments in either cover shell, comprising: a compartment cover board fastened to at least one of the cover shells so as to cover the tool compartments to keep stored tools and tool accessories in place, said compartment cover board having: a plurality of bottom pins fitted into respective pin holes on the at least one cover shell for positioning; a plurality of storage chambers spaced around a periphery of the compartment cover board for storing small measuring tools; weights and measures conversion tables and measuring scales respectively located on two opposite surfaces thereof; and a plurality of gage holes disposed on one surface of the compartment cover board for keeping gages.

2. The tool box of claim 1 wherein said compartment cover board comprises a flat plate having a thickness of 1 cm.

3. The tool box of claim 1 wherein said storage chambers of said compartment cover board are configured to store calipers, angle meters, and steel rules.

4. The tool box of claim 1 wherein said gage holes comprise a plurality of screw gage holes for keeping screw gages.

5. The tool box of claim 1 wherein said gage holes comprise a plurality of nut and bolt gage holes for keeping nut and bolt gages.

* * * * *